US006152753A

United States Patent [19]

Johnson et al.

[11] Patent Number: 6,152,753

[45] Date of Patent: Nov. 28, 2000

[54] ANTI-DECOUPLING ARRANGEMENT FOR AN ELECTRICAL CONNECTOR

[75] Inventors: Heath Allen Johnson, Bainbridge; Clifford Joseph Westrick, Oneonta; David Leigh Frear, Bainbridge, all of N.Y.

[73] Assignee: Amphenol Corporation, Wallingford, Conn.

[21] Appl. No.: 09/487,214

[22] Filed: Jan. 19, 2000

[51] Int. Cl.[7] ..... H01R 4/38; H01R 13/62

[52] U.S. Cl. ..... 439/321; 439/312

[58] Field of Search ..... 439/321, 320, 439/312, 310, 319, 318; 285/82

[56] References Cited

U.S. PATENT DOCUMENTS

| | | | |
|---|---|---|---|
| 4,030,798 | 6/1977 | Paoli | 439/321 |
| 4,109,990 | 8/1978 | Waldron et al. . | |
| 4,472,013 | 9/1984 | Frear | 439/312 |
| 4,478,474 | 10/1984 | Gallusser et al. | 439/312 |
| 4,479,689 | 10/1984 | Marmillion et al. . | |
| 4,484,790 | 11/1984 | Schildkraut et al. . | |
| 4,487,470 | 12/1984 | Knapp et al. . | |
| 4,508,408 | 4/1985 | Shepler et al. | 439/313 |
| 4,519,661 | 5/1985 | Brush, Sr. et al. . | |
| 4,525,017 | 6/1985 | Schildkraut et al. | 439/320 |
| 4,536,048 | 8/1985 | Schildkraut et al. . | |
| 4,588,246 | 5/1986 | Schildkraut et al. . | |
| 4,641,811 | 2/1987 | Gallusser et al. | 249/122 |
| 4,726,782 | 2/1988 | Hager et al. | 439/322 |
| 4,746,303 | 5/1988 | Cobraiville et al. | 439/321 |
| 4,808,117 | 2/1989 | Gale et al. | 439/321 |
| 4,808,123 | 2/1989 | Dee et al. | 439/470 |
| 4,984,995 | 1/1991 | Tucker et al. | 439/321 |
| 5,082,454 | 1/1992 | Tonkiss et al. | 439/320 |
| 5,145,394 | 9/1992 | Hager | 439/321 |
| 5,199,894 | 4/1993 | Kalny et al. | 439/321 |
| 5,681,177 | 10/1997 | Mikolaicyk et al. | 439/321 |
| 5,702,263 | 12/1997 | Baumann et al. | 439/321 |

*Primary Examiner*—Steven L. Stephan
*Assistant Examiner*—Hae Moon Hyeon
*Attorney, Agent, or Firm*—Blank Rome Comisky & McCauley, LLP

[57] ABSTRACT

An anti-decoupling arrangement for an electrical connector (as well as an electrical connector incorporating such an anti-decoupling arrangement) is made up of just three operative components: a spiral lock clutch, at least one spring ring, and ratchet teeth or serrations formed on an inside surface of the coupling nut. The ratchet teeth are in the form of serrations formed into the inside diameter of a recessed area of the coupling nut in which all of the components reside, and each spring ring is a self-supporting ring that has spring cantilevers with engaging tines of a given number located around its outer circumference, the engaging tines engaging the serrations in a radial direction. The engaging tines thus provide a torque/ratchet mechanism when they glide over the radial cuts of the tooth ring in the uncoupling direction, and stay engaged which forces the spiral lock clutch to expand and slide smoothly over the plug shell with minimal torque in the coupling direction.

15 Claims, 4 Drawing Sheets

FIG. 2
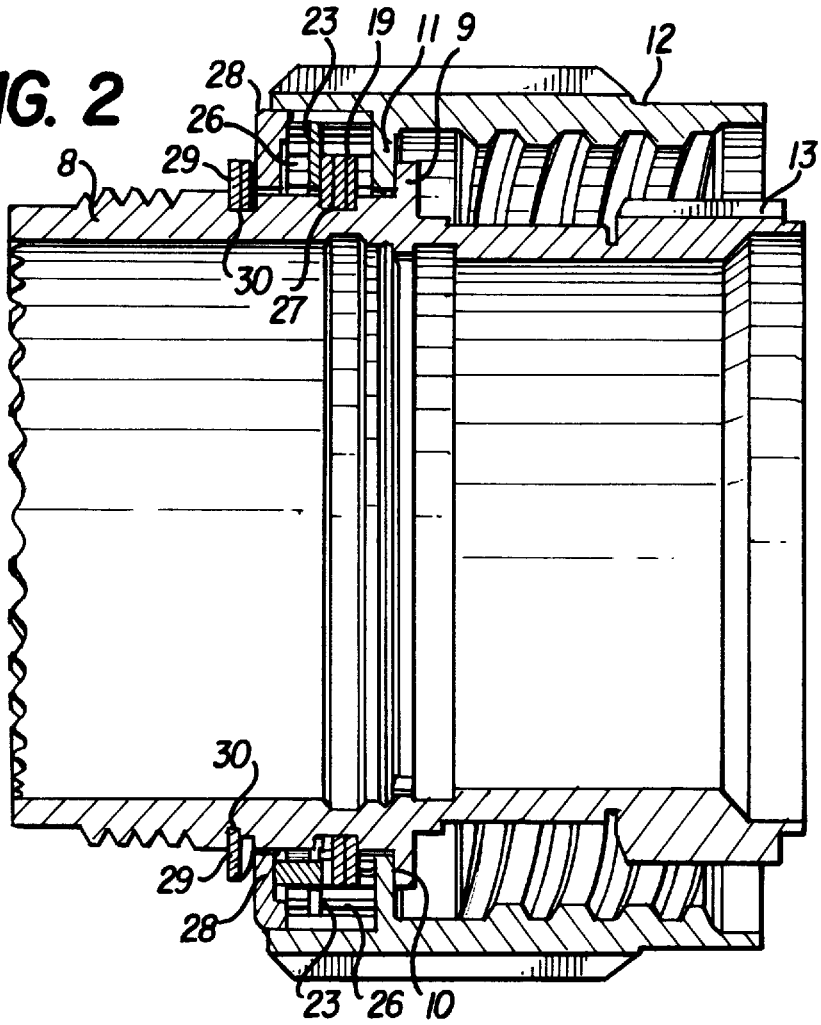
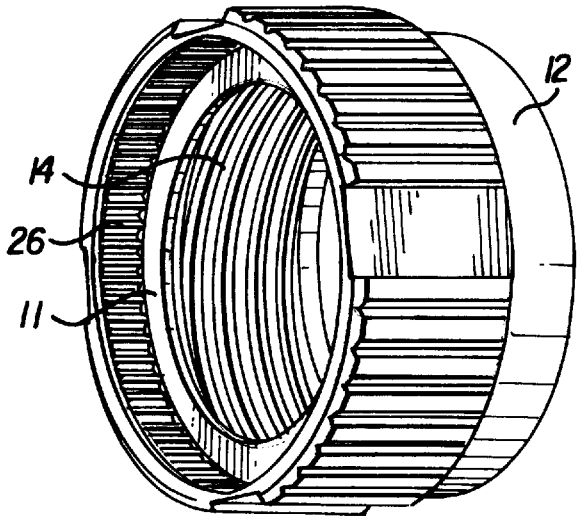
FIG. 3

ANTI-DECOUPLING ARRANGEMENT FOR AN ELECTRICAL CONNECTOR

BACKGROUND OF THE INVENTION

1. Field of the Invention

The present invention generally relates to anti-decoupling arrangements for connectors of the type in which coupling is achieved by means of a coupling nut, and more particularly to an anti-decoupling arrangement for an electrical connector that uses a ratchet mechanism to limit rotation of the coupling nut in the decoupling direction and a spiral lock clutch to permit free rotation of the coupling nut in the coupling direction. Still more particularly, the invention relates to improvements on the anti-decoupling arrangement disclosed in copending U.S. patent application Ser. No. 09/391,458, filed Sep. 8, 1999, incorporated by reference herein.

2. Description of the Related Art

A typical connector to which the present invention may be applied includes a connector shell containing electrical contacts and an internally threaded coupling nut rotatably mounted on the connector shell. The connector shell is coupled to a corresponding externally threaded mating connector by means of the coupling nut in such a manner that electrical contacts in the mating connector engage the electrical contacts in the connector shell. The coupling nut is held on the connector shell by one or more retaining rings and/or spring washers that are designed to captivate or press a radial flange of the coupling nut against a corresponding flange or shoulder on the connector shell.

Because the frictional anti-locking force generated by engagement between the coupling nut and connector shell in such an arrangement is insufficient to prevent the coupling nut from rotating in a decoupling direction as a result of vibrations or shocks, compromising seals and possibly affecting the integrity of the electrical connections between contacts, it is conventional to include an additional anti-decoupling mechanism in connectors likely to be used in environments where vibrations or shocks are likely to occur, such as in military high-performance aircraft and other vehicles. The simplest and most common method of preventing unintended decoupling as a result of shocks or vibrations has been to include in the connector a metal ratchet spring having protrusions or dimples at the center of the beam, the ratchet spring being permanently attached to the inside diameter of the threaded coupling nut. The connector shell is provided with ratchet teeth on its outer diameter, which are engaged by the ratchet spring.

One problem with this type of coupling is that the discrete detent positions do not necessarily lie in phase with the fully clamped position of the ring, such that even slight vibrations can cause the ring to back off slightly, which can cause sealing problems. In addition, the detent members in this configuration have very little effective surface area, causing rapid wearing away of the teeth on the ratchet wheel each time the connector is mated or unmated.

A solution to the problems of wear and phasing of the ratchet teeth and detents is described in copending U.S. patent application Ser. No. 09/391,458, which is directed to various improvements in a spiral lock clutch anti-decoupling mechanism originally proposed in U.S. Pat. No. 4,536,048. The anti-decoupling mechanism described in the copending patent application includes a spiral lock clutch that permits free running in the coupling direction, a spring ring, and a tooth wheel all surrounding a connector shell and captured between a snap-ring on the connector shell and an inwardly extending flange on the coupling nut. The tooth wheel includes extensions or knurls that cooperate with corresponding slots or surfaces of the coupling nut to prevent relative rotation between the coupling nut and the tooth wheel, while the spring ring includes spring tines that engage radial cuts in the tooth wheel to permit ratcheting of the tooth wheel relative to the spring ring. The spring ring, in turn, is locked against rotation relative to the spiral lock clutch. During coupling, turning of the coupling nut causes corresponding turning of the tooth wheel. Since the spiral lock clutch is arranged to unwind and permit free running in the coupling direction, the engagement between the spring tines on the spring ring and the radial cuts is not subject to any ratcheting force and the spring ring and spiral lock clutch turn freely with the coupling nut and tooth wheel. During uncoupling, on the other hand, the spiral lock clutch winds tightly against the connector shell, preventing rotation of the spiral lock clutch and spring ring. In order to permit the coupling nut to rotate, a sufficient force must be applied to the coupling nut to permit ratcheting of the spring ring relative to the tooth wheel, i.e., to permit the spring tines to glide over the teeth formed by the radial cuts in the ratchet wheel.

The above-described anti-decoupling arrangement has the advantages, relative to the anti-decoupling arrangement described in U.S. Pat. No. 4,536,048, of attaining a high uncoupling torque due to the use of multiple tines or beams on the spring ring attached to the spiral lock clutch, control of the coupling torque through appropriate choice of the spiral lock clutch, spring tines, and tooth configuration, and simplified assembly to the connector shell by fitting all of the components over the shell, angularly orienting the components, and holding them in place with a retaining ring. Nevertheless, the above-described anti-decoupling mechanism still could benefit from the following improvements:

(i) a greater degree of adjustment of the de-coupling torque;

(ii) a still higher de-coupling torque than can be achieved with the prior arrangement;

(iii) smoother non-binding operation; and (iv) a less critical assembly method.

These improvements are achieved by modifying the anti-decoupling device described in the copending patent application so that the clutch mechanism and the ratchet mechanism operate completely independently of one another in a non-interfering manner, and in particular by:

(i) arranging the ratchet assembly cantilever beams so that they operate radially outwardly rather than axially; and (ii) eliminating the ratchet assembly detent ring (i.e., the toothed wheel) used in the prior anti-decoupling arrangement in favor of serrations formed into the inner diameter of the coupling nut.

These modifications not only reduce the number of components and also provide mechanical advantages that increase the range of possible decoupling torques, but they also eliminate any interference between the coupling nut shoulder and the back side of the spiral wound clutch band so as to provide a smoother coupling feel and a more positive and stronger clutch grip, eliminate press fits or keyed components that complicate assembly, permit a stronger and more easily assembled attachment of the spring ring to the spiral wound clutch, reduce tolerance build-up between components (due to the smaller number of axially stacked components), and make it possible to more easily disassemble the anti-coupling mechanism for repair or torque adjustment.

SUMMARY OF THE INVENTION

It is accordingly a first objective of the invention to provide an electrical connector anti-decoupling mechanism of the type including a spiral lock clutch and ratcheting mechanism arranged to permit free running in the coupling direction and ratcheting in the decoupling direction, and that provides increased decoupling torque.

It is a second objective of the invention to provide an electrical connector anti-decoupling mechanism of the type including a spiral lock clutch and ratcheting mechanism arranged to permit free running in the coupling direction and ratcheting in the decoupling direction, and that provides a more adjustable decoupling torque.

It is a third objective of the invention to provide an electrical connector anti-decoupling mechanism of the type including a spiral lock clutch and ratcheting mechanism arranged to permit free running in the coupling direction and ratcheting in the decoupling direction, and that provides a smoother coupling feel by eliminating interference between the coupling nut shoulder and the back side of the spiral wound clutch band.

It is a fourth objective of the invention to provide an electrical connector anti-decoupling mechanism of the type including a spiral lock clutch and ratcheting mechanism arranged to permit free running in the coupling direction and ratcheting in the decoupling direction, and that provides a stronger clutch grip by eliminating interference between the coupling nut shoulder and the back side of the spiral wound clutch band.

It is a fifth objective of the invention to provide an electrical connector anti-decoupling mechanism of the type including a spiral lock clutch and ratcheting mechanism arranged to permit free running in the coupling direction and ratcheting in the decoupling direction, and that requires fewer complex components.

It is a sixth objective of the invention to provide an electrical connector anti-decoupling mechanism of the type including a spiral lock clutch and ratcheting mechanism arranged to permit free running in the coupling direction and ratcheting in the decoupling direction, and that permit easier and less costly assembly due to the elimination of press fits or keyed components.

It is a seventh objective of the invention to provide an electrical connector anti-decoupling mechanism of the type including a spiral lock clutch and ratcheting mechanism arranged to permit free running in the coupling direction and ratcheting in the decoupling direction, and in which attachment of a spring ring to the spiral lock clutch is made stronger and yet easier to assemble.

It is an eighth objective of the invention to provide an electrical connector anti-decoupling mechanism of the type including a spiral lock clutch and ratcheting mechanism arranged to permit free running in the coupling direction and ratcheting in the decoupling direction, and reduces deviation in decoupling torque by reducing the number of components and therefore lower tolerance build-up between the components.

It is a ninth objective of the invention to provide an electrical connector anti-decoupling mechanism of the type including a spiral lock clutch and ratcheting mechanism arranged to permit free running in the coupling direction and ratcheting in the decoupling direction, and that suffers from less wear in the ratchet assembly due to the beam tip shape and detent form resulting from the radial rather than axial engagement between the parts of the ratchet mechanism.

It is a tenth objective of the invention to provide an electrical connector anti-decoupling mechanism of the type including a spiral lock clutch and ratcheting mechanism arranged to permit free running in the coupling direction and ratcheting in the decoupling direction, and in which tolerance of a spring ring portion of the ratcheting mechanism is easier to control due to being flat stamped with no forming of the cantilever beams required.

It is an eleventh objective of the invention to provide an electrical connector anti-decoupling mechanism of the type including a spiral lock clutch and ratcheting mechanism arranged to permit free running in the coupling direction and ratcheting in the decoupling direction, and that can be disassembled without any special tools and without destroying any of the components of the mechanism, allowing for field repairability and torque adjustments.

These objectives are achieved, in accordance with the principles of a preferred embodiment of the invention, by providing an anti-decoupling arrangement for an electrical connector (as well as an electrical connector incorporating such an anti-decoupling arrangement) which consists of just three operative components: a spiral lock clutch, at least one spring ring, and ratchet teeth or serrations formed on an inside surface of the coupling nut. The ratchet teeth are in the form of serrations formed into the inside diameter of a recessed area of the coupling nut in which all of the components reside, and each spring ring is a self-supporting ring that has spring cantilevers with engaging tines of a given number located around its outer circumference, the engaging tines engaging the serrations in a radial direction. The engaging tines thus provide a torque/ratchet mechanism when they glide over the radial cuts of the tooth ring in the uncoupling direction.

In order to assemble the anti-decoupling mechanism of the invention, the coupling nut may be assembled to the shell so that it bottoms out shoulder to shoulder, and subsequently the spiral clutch band is assembled onto the shell at a position spaced from but near a shoulder extending from the shell. If a groove is provided, the clutch band may be assembled in the groove. A tapered shaft is fitted over the rear of the plug shell to temporarily enlarge the spiral lock clutch band, allowing it to slide over the rear of the shell and down into the first groove. The spring ring or rings are then assembled onto the spiral lock clutch by aligning respective complementary interengaging structures on the spring ring or rings and on the spiral lock clutch band, the complementary interengaging structures including, by way of example and not limitation, a slot in each spring ring and a small hook like bend on the end of the spiral lock clutch band. Those skilled in the art will of course appreciate that the order of assembly may be varied within the scope of the invention, for example, by first assembling the spring ring or rings to the plug shell, and then assembling the clutch.

In operation, when the coupling nut is turned in a coupling or mating direction, the serrations on the coupling nut engage the spring tines and cause each spring ring to also turn in the coupling direction, which causes the spiral lock clutch to turn in the coupling direction. Turning of the spiral lock clutch in the coupling direction causes it to unwind from the connector shell and freely rotate, thus permitting coupling to occur without any resistance from the anti-decoupling mechanism.

On the other hand, when the coupling nut is rotated in an unmating or decoupling direction, the spring tines are pushed by the serrations to rotate in the uncoupling direction, causing the spiral lock clutch to tighten and prevent further rotation of the spring ring, the tines of which are then ratcheted over the teeth of the tooth ring to provide resistance to uncoupling.

BRIEF DESCRIPTION OF THE DRAWINGS

FIG. 2 is a cross-sectional side view of the electrical connector and anti-decoupling arrangement of FIG. 1.

FIG. 3 is an isometric view showing details of a coupling nut for use in the anti-decoupling arrangement of the preferred embodiment.

DETAILED DESCRIPTION OF THE PREFERRED EMBODIMENTS

Figure 1:
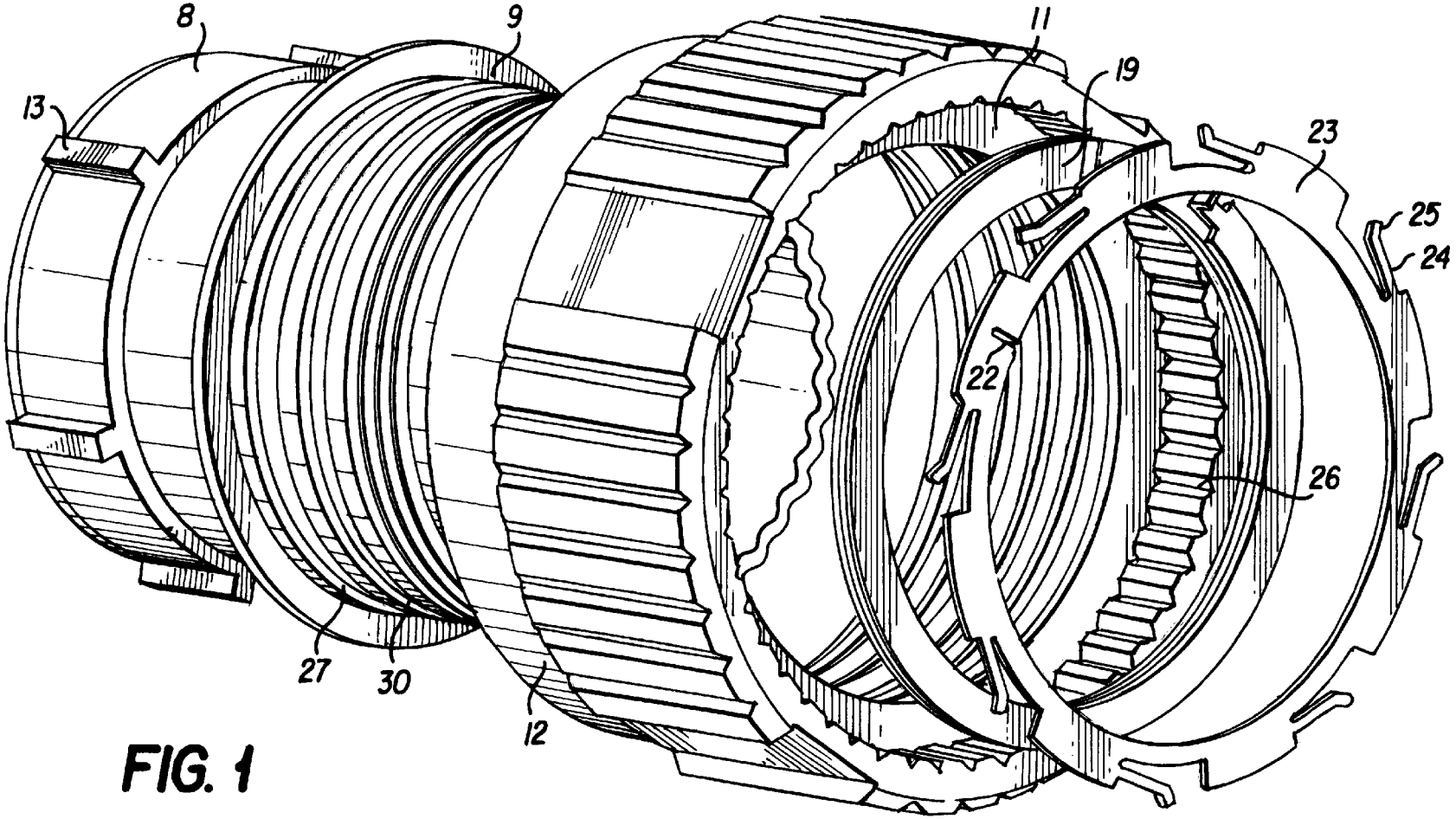
FIG. 1 is an isometric view showing an electrical connector anti-decoupling arrangement constructed in accordance with the principles of a preferred embodiment of the invention.

As illustrated in FIGS. 1–3 and 5, a connector having an anti-decoupling mechanism constructed in accordance with the principles of a preferred embodiment of the invention includes a plug connector shell 8 having a front mating section corresponding to the one illustrated in U.S. Pat. No. 4,536,048, incorporated herein by reference. Between the front and rear section of the plug connector shell 8 is a flange or shoulder 9 having a rear surface 10 which faces a collar or flange 11 extending radially inwardly from the coupling nut 12.

The illustrated connector shell 8 and coupling nut 12 have the general configuration of a type of connector known as the "Series III" connector, including such features as polarizing keys 13, and a standard Tri-start thread 14 on the coupling nut 12. However, although the anti-decoupling arrangement of the preferred embodiment is especially suitable for use in the Series III connector, which is designed to be used in harsh environments (the standards therefor being specified in standard shell sizes 9–25 according to MIL-C-38999/26D, dated May 7, 1990), those skilled in the art will appreciate that the principles of the invention are not limited to Series III connectors, but rather are applicable to any cylindrical connectors having threaded couplings and a need for an anti-decoupling arrangement.

Figure 6:
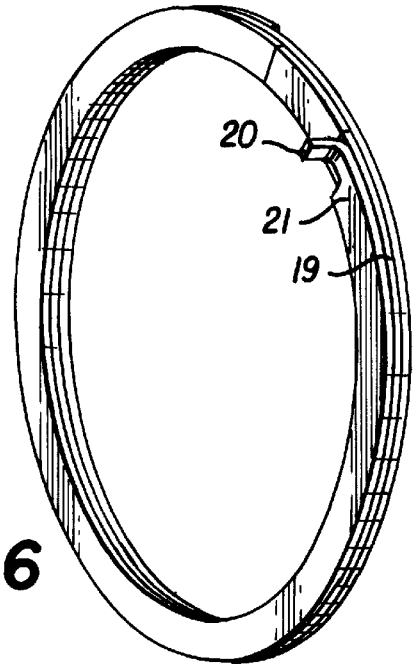
FIG. 6 is an isometric view showing details of a spiral lock clutch for use in the anti-decoupling arrangement of the preferred embodiment.
Figure 5:
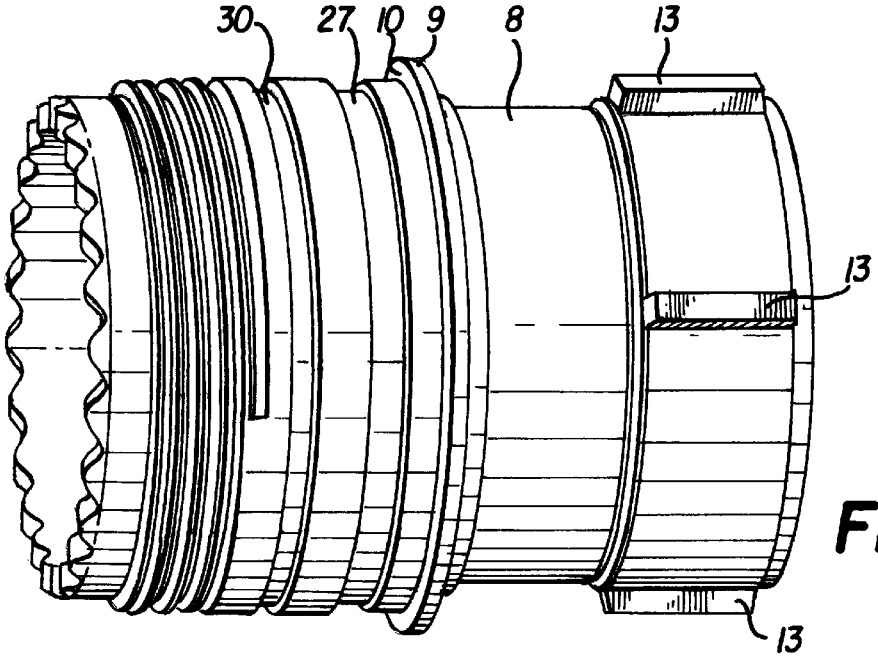
FIG. 5 is an isometric view showing details of a plug shell for use with the anti-decoupling arrangement of the preferred embodiment.

To the rear of the flange 9 of connector shell 8 and collar 11 of coupling nut 12 is a spiral lock clutch 19, illustrated in detail in FIG. 6. Spiral lock clutch 19 is preferably in the form of a wound radial spring band surrounding the shell 13. The spiral lock clutch may be loosely captured in a groove 27 situated rearwardly of flange 9, although it is also within the scope of the invention to omit groove 27, and includes a small hook like bend or tab 20 extending from one end 21 of the band in a transverse direction relative to the principal plane of the band so as to project rearwardly of the band when the band is assembled to the plug shell 8.

Tab 20 is arranged to engage a slot 22 extending from an inside diameter of a spring ring 23 such that when the spring ring 23 is fitted onto the plug connector shell 8 and oriented so that slot 22 aligns with tab 20, spring ring 23 and end 21 of the band are thereby locked against relative rotational movement. Except for the tab 20, spiral lock clutch 19 may be similar to the spiral ring disclosed in the above-cited copending U.S. patent application Ser. No. 09/391,458. Although illustrated as a tab 20 on the spiral lock clutch 19 and a slot 22 on the spring ring 23, those skilled in the art will appreciate that the means by which clutch 19 and ring 23 are locked together against relative rotational movement may take a variety of forms, such as a tab on clutch 19 and a slot, notch, or groove situated away from the inside diameter of the spring ring 23, a slot in the clutch and tab on the spring ring, a weld joint, or any other suitable joining structure.

Figure 4:
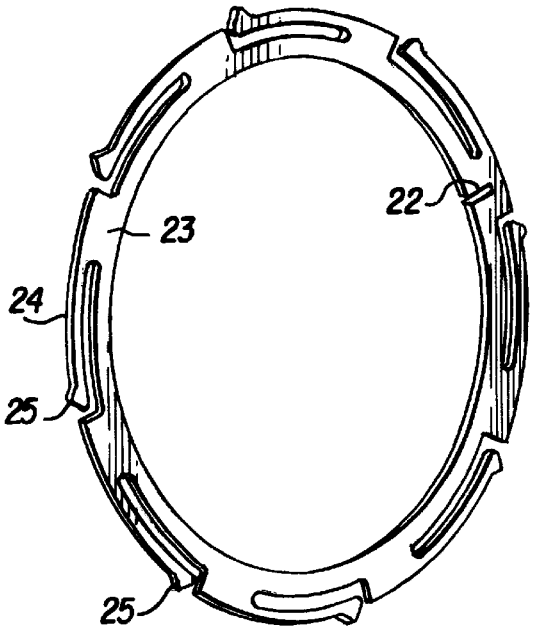
FIG. 4 is an isometric view showing details of a spring ring for use in the anti-decoupling arrangement of the preferred embodiment.
Figure 7:
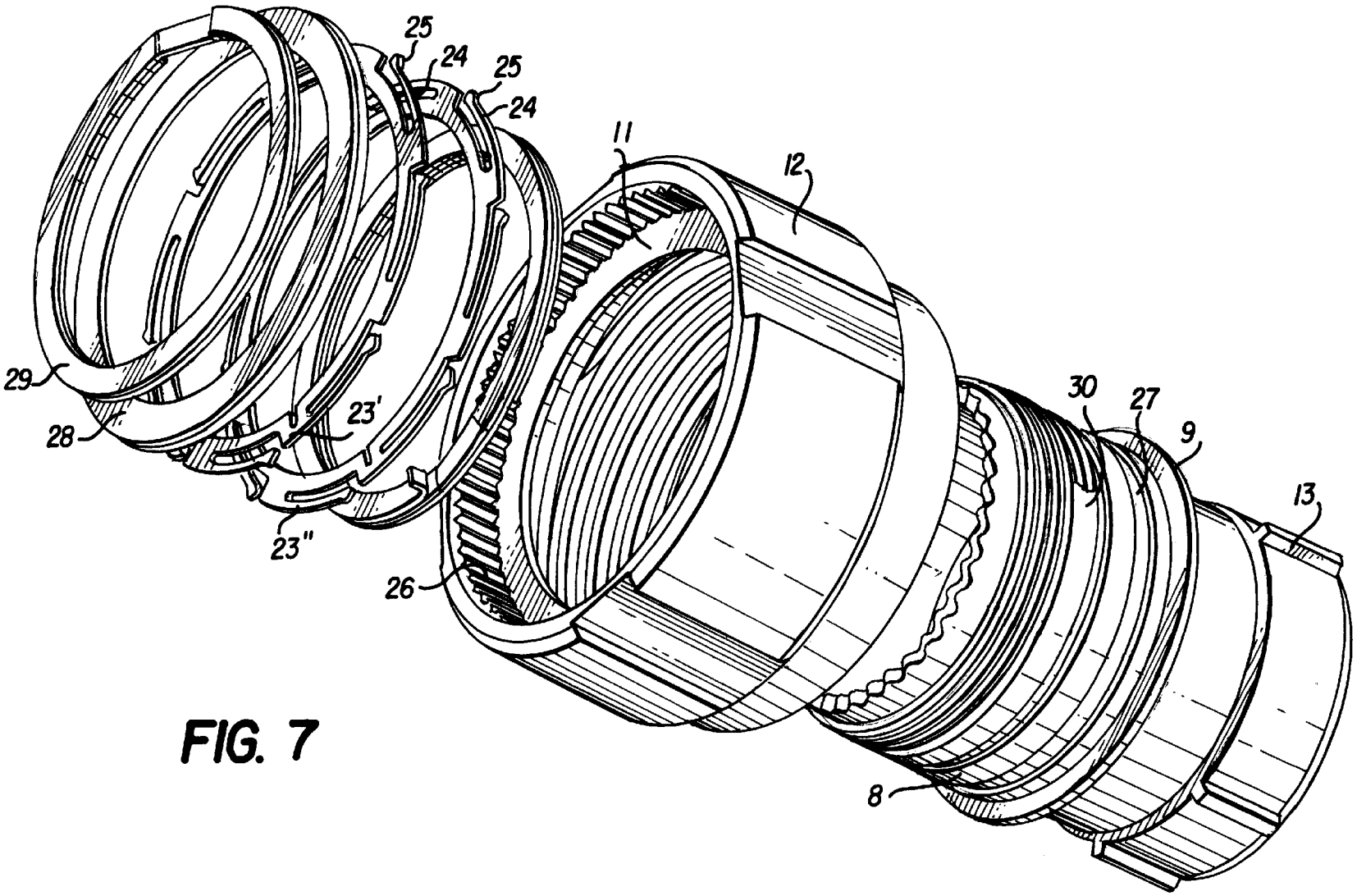
FIG. 7 is an isometric view showing an electrical connector anti-decoupling arrangement constructed in accordance with the principles of a second preferred embodiment of the invention.

Spring ring 23 includes, in addition to slot 22, a plurality of spring tines or beams 24 arranged to flex in a radial direction, as shown in FIG. 4. Spring beams 24 include, at their distal ends, radially outwardly extending angled sections or detents 25 arranged to cooperate with corresponding serrations 26 formed into the inside surface of coupling nut 12 to provide a ratcheting effect, as described below, when the spring ring 23 is fitted over plug shell 8 such that the serrations surround the spring ring. Unlike the spring ring described in the above-cited copending U.S. patent application Ser. No. 09/391,458, spring ring 23 of the preferred embodiment is completely planar in construction and therefore can be more easily manufactured. In addition, as illustrated in FIG. 7, the planar construction and radial engagement of beams 24 with serrations 26 permits multiple spring rings 23',23" of the same or different thickness to be stacked upon one another as a way to adjust torque without having to change the design of any of the other components of the anti-decoupling mechanism. Although two spring rings are illustrated, those skilled in the art will appreciate that the number of spring rings may be increased to three or more without departing from the scope of the invention.

Coupling nut 12 preferably takes the form of a standard coupling nut, with the addition of serrations 26, and is held on the plug shell 8 by a cover ring 28 and standard retaining ring 29 situated in a second groove 30, completing the anti-decoupling mechanism. It will of course be appreciated by those skilled in the art that the combination of a cover ring and retaining ring may be replaced by any suitable retention mechanism, including a non-standard retaining ring that extends outwardly far enough to engage the coupling nut.

Because detents 25 can engage the serrations 26 anywhere along their axial length without affecting the engagement force and therefore the decoupling torque, the invention provides for a much greater axial tolerance in positioning the spring ring 23 or rings 23',23" and the spiral lock clutch 19, and a much simpler structure overall, than is possible in the anti-decoupling mechanism described in copending U.S. patent application Ser. No. 09/391,458, which is why the spiral lock clutch can be loosely fitted into groove 27 or simply positioned over the outside surface of the plug shell 8, and why the adjustment of the torque is a function solely of the number of spring rings 23,23',23 ", the configuration of beams 24 and detents 25, the shape of serrations 26, and the configuration and number of turns of the spiral lock clutch 19, eliminating the dependence of the decoupling torque on axial positioning and permitting a greater range of torque adjustments.

The anti-decoupling mechanism of the preferred embodiments illustrated in FIGS. 1–7 may assembled to the connector, as follows:

(i) The coupling nut is assembled onto the shell such that it bottoms out shoulder to shoulder, with radially inwardly extending flange 11 facing radially outwardly extending flange or shoulder 9.

(ii) A tapered shaft is then fitted over the rear of the plug shell to temporarily enlarge the spiral lock clutch band 19, allowing it be to slide over the rear of the shell and down into the first groove 27.

(iii) The spring ring 23 or rings 23',23" is/are then assembled onto the spiral lock clutch 19 by aligning tab 20 on clutch 19 with slot 22 on spring ring 23, so that the spring ring 23 or rings 23',23" and the clutch 19 are held angularly by engagement between the tab 20 and slot 22.

(iv) Finally, cover ring 28 is positioned on the shell so as to capture the coupling nut 12, and retaining ring 29 is fitted into the second groove 30 to entrap the entire anti-decoupling assembly. Of course, these steps may also be varied without departing from the scope of the invention, which is defined solely by the appended claims.

The connector thus assembled operates as follows: When the coupling nut 12 is rotated in the mating or coupling direction, serrations 26 exert a torque on cantilever beams 24 and detents 25, rotating the spring ring 23 or rings 23',23", which in turn rotates the spiral lock clutch 19 in a direction that causes the clutch to unwind from the plug connector shell 8 and freely rotate relative thereto. As a result, the coupling nut can be rotated with a light torque to secure the coupling nut 12 to a mating connector.

When a torque is applied to the coupling nut 12 in the decoupling direction, the cantilever beams 24 and detents 25 of the spring ring 23 or rings 23',23" against the opposite faces of the serrations 26, causing the spring ring or rings to attempt to rotate the spiral lock clutch 19 in the decoupling direction. This decoupling torque locks the clutch and spring ring or rings to the plug connector shell. When the decoupling torque applied to the coupling nut exceeds a threshold (preferably above the value of any vibration or shock induced torques to which the connector is subject), since the spring ring 23 or rings 23',23" is/are locked against rotation by the spiral lock clutch 19, the serrations 26 are forced to ratchet over the cantilever beams 24, thereby permitting the coupling nut 12 to be decoupled from the corresponding externally threaded portion of the mating connector.

Having thus described a preferred embodiment of the invention and variations of the preferred embodiment in sufficient detail to enable those skilled in the art to make and use the invention, it will nevertheless be appreciated by those skilled in the art that the illustrated connector and decoupling arrangement may be further varied or modified by those skilled in the art.

For example, the type of connector to which the decoupling arrangement of the preferred embodiment is applied may be freely modified, as may such details as the nature of the complementary interengaging surfaces between the coupling nut and the plug connector shell (i.e., flanges 9 and 11) or the structures that lock the spring ring 23 to the spiral lock clutch 19.

Each of these variations and modifications, including those not specifically mentioned herein, is intended to be included within the scope of the invention, and thus the description of the invention and the illustrations thereof are not to be taken as limiting, but rather it is intended that the invention should be defined solely by the appended claims.

What is claimed is:

1. An anti-decoupling arrangement arranged to be fitted on a connector shell having a front mating end and a coupling nut fitted over the connector shell, said anti-decoupling arrangement preventing rotation of the coupling nut in a decoupling direction, comprising:

a spiral lock clutch extending around said connector shell;

at least one spring ring positioned to the rear of the spiral lock clutch, front and rear being hereinafter taken relative to an axis of the connector shell and its front mating end, said spring ring also extending around said connector shell, said spring ring and spiral lock clutch being locked together against relative movement so that the spiral lock clutch rotates with the spring ring, and said spring ring further including cantilever beams, the distal ends of which are formed with radially outwardly extending detents;

serrations on an inside surface of said coupling nut, said serrations engaging said detents; and at least one retention member positioned to the rear of the coupling nut to capture the tooth ring, spring ring, spiral lock clutch, and coupling nut and retain them on the connector shell, wherein when said coupling nut is rotated in a coupling direction, said engagement of said cantilever beams with said serrations causes rotation of the spring ring in the coupling direction, the rotation of the spring ring causing rotation of the spiral lock clutch in the coupling direction, said spiral lock clutch being arranged to freely rotate relative to the connector shell and thereby provide minimal resistance to said rotation of the coupling nut in the coupling direction, wherein when a torque less than a threshold value is applied to said coupling nut in a decoupling direction, a corresponding torque is applied by the serrations to the spring ring in the decoupling direction, and said torque applied to the spring ring in the decoupling direction causing said spiral lock clutch to lock and prevent rotation of the spring ring in the decoupling direction, and wherein when a torque greater than a threshold value is applied to the coupling nut in the decoupling direction, said greater torque causes said serrations to ratchet over said detents and thereby permit the coupling nut to be rotated in the decoupling direction despite continued locking of the spiral lock clutch and spring ring against rotation.

2. An arrangement as claimed in claim 1, wherein said spiral lock clutch is a wound radial spring band.

3. An arrangement as claimed in claim 2, wherein said clutch includes a tab extending transversely from one end of the spiral lock clutch, and said spring ring includes a slot arranged to engage said tab and thereby prevent relative rotation between said spring ring and said clutch.

4. An arrangement as claimed in claim 1, wherein said shell is an electrical connector shell.

5. An arrangement as claimed in claim 4, wherein said shell is a Series III connector shell.

6. An arrangement as claimed in claim 1, wherein said retention member includes a retaining ring and a cover ring arranged to engage said coupling nut.

7. An arrangement as claimed in claim 1, further comprising at least one additional spring ring positioned to the rear of the spiral lock clutch and locked together with said first spring ring and clutch against relative movement, said additional spring ring including additional cantilever beams, distal ends of which are formed with radially outwardly extending additional detents, said serrations engaging said additional detents.

8. An electrical connector including a connector shell having a front mating end, a coupling nut fitted over the connector shell, and an anti-decoupling arrangement preventing rotation of the coupling nut in a decoupling direction, said anti-decoupling arrangement comprising:

a spiral lock clutch extending around said connector shell;

at least one spring ring positioned to the rear of the spiral lock clutch, front and rear being hereinafter taken relative to an axis of the connector shell and its front mating end, said spring ring also extending around said connector shell, said spring ring and spiral lock clutch being locked together against relative movement so that the spiral lock clutch rotates with the spring ring, and said spring ring further including cantilever beams, the distal ends of which are formed with radially outwardly extending detents;

serrations on an inside surface of said coupling nut, said serrations engaging said detents; and at least one retention member positioned to the rear of the coupling nut to capture the tooth ring, spring ring, spiral lock clutch, and coupling nut and retain them on the connector shell, wherein when said coupling nut is rotated in a coupling direction, said engagement of said cantilever beams with said serrations causes rotation of the spring ring in the coupling direction, the rotation of the spring ring causing rotation of the spiral lock clutch in the coupling direction, said spiral lock clutch being arranged to freely rotate relative to the connector shell and thereby provide minimal resistance to said rotation of the coupling nut in the coupling direction, wherein when a torque less than a threshold value is applied to said coupling nut in a decoupling direction, a corresponding torque is applied by the serrations to the spring ring in the decoupling direction, and said torque applied to the spring ring in the decoupling direction causing said spiral lock clutch to lock and prevent rotation of the spring ring in the decoupling direction, and wherein when a torque greater than a threshold value is applied to the coupling nut in the decoupling direction, said greater torque causes said serrations to ratchet over said detents and thereby permit the coupling nut to be rotated in the decoupling direction despite continued locking of the spiral lock clutch and spring ring against rotation.

9. An electrical connector as claimed in claim 8, wherein said spiral lock clutch is a wound radial spring band.

10. An electrical connector as claimed in claim 9, wherein said spiral lock clutch is situated in a groove in said connector shell.

11. An electrical connector as claimed in claim 8, wherein said clutch includes a tab extending transversely from one end of the spiral lock clutch, and said spring ring includes a slot arranged to engage said tab and thereby prevent relative rotation between said spring ring and said clutch.

12. An electrical connector as claimed in claim 8, wherein said shell is an electrical connector shell.

13. An electrical connector as claimed in claim 12, wherein said shell is a Series III connector shell.

14. An electrical connector as claimed in claim 8, wherein said retention member includes a retaining ring and a cover ring arranged to engage said coupling nut.

15. An electrical connector as claimed in claim 8, further comprising at least one additional spring ring positioned to the rear of the spiral lock clutch and locked together with said first spring ring and clutch against relative movement, said additional spring ring including additional cantilever beams, distal ends of which are formed with radially outwardly extending additional detents, said serrations engaging said additional detents.

* * * * *